US007637211B2

(12) United States Patent
Berberich et al.

(10) Patent No.: US 7,637,211 B2
(45) Date of Patent: Dec. 29, 2009

(54) METHOD OF PREADJUSTING A WEB-MACHINING AND/OR WEB-PROCESSING MACHINE, METHOD FOR SELECTING A LEG DIRECTION MEANS AND PREADJUSTMENT SYSTEM

(75) Inventors: Heiko Heinz Berberich, Moosach (DE); Burkard Otto Herbert, Würzburg (DE); Matthias Willi Horn, Holzkirchen (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 328 days.

(21) Appl. No.: 10/546,378

(22) PCT Filed: Feb. 11, 2004

(86) PCT No.: PCT/EP2004/050117

§ 371 (c)(1),
(2), (4) Date: Jun. 20, 2006

(87) PCT Pub. No.: WO2004/073986

PCT Pub. Date: Sep. 2, 2004

(65) Prior Publication Data

US 2007/0012211 A1 Jan. 18, 2007

(30) Foreign Application Priority Data

Feb. 20, 2003 (DE) ..... 103 07 202

(51) Int. Cl.

| | |
|---|---|
| ***B41F 13/58*** | (2006.01) |
| ***B41F 13/56*** | (2006.01) |
| ***B41F 13/54*** | (2006.01) |
| ***B41F 1/34*** | (2006.01) |
| ***B41F 21/12*** | (2006.01) |
| ***B41F 21/14*** | (2006.01) |
| ***B41L 1/02*** | (2006.01) |
| ***B65H 20/24*** | (2006.01) |

(52) U.S. Cl. ..... 101/485; 226/110

(58) Field of Classification Search ..... 101/224, 101/225, 226, 227, 228, 485; 226/109, 110; 270/52.08, 52.09

See application file for complete search history.

(56) References Cited

U.S. PATENT DOCUMENTS

| | | | | |
|---|---|---|---|---|
| 3,942,782 | A | 3/1976 | Hermach | |
| 4,520,454 | A * | 5/1985 | Dufour et al. | 358/1.18 |
| 4,725,050 | A * | 2/1988 | Fujishiro | 270/5.01 |
| 5,303,909 | A | 4/1994 | Maylaender | |
| 5,325,774 | A | 7/1994 | Breton et al. | |
| 5,436,844 | A * | 7/1995 | Tokiwa | 700/122 |

(Continued)

FOREIGN PATENT DOCUMENTS

| | | |
|---|---|---|
| DE | 25 10 057 | 9/1975 |

(Continued)

*Primary Examiner*—Judy Nguyen
*Assistant Examiner*—Leo T Hinze
(74) *Attorney, Agent, or Firm*—Jones, Tullar & Cooper, P.C.

(57) ABSTRACT

At least one unit of a web-machinery, or a web-processing machine is pre-adjusted in a method which influences a longitudinal register. An adjustment value is derived for that at least one unit based on previously-obtained data. The adjustment value is stored in a machine control unit.

5 Claims, 6 Drawing Sheets

U.S. PATENT DOCUMENTS

| | | | | |
|---|---|---|---|---|
| 5,503,379 | A * | 4/1996 | Michalik et al. | 270/5.01 |
| 6,024,684 | A * | 2/2000 | Maylander et al. | 493/346 |
| 6,360,665 | B1 | 3/2002 | Hartmann et al. | |
| 6,377,247 | B1 * | 4/2002 | Halverson et al. | 345/173 |
| 6,408,748 | B1 | 6/2002 | Hajek et al. | |
| 6,422,552 | B1 * | 7/2002 | Chesno et al. | 270/32 |
| 6,532,872 | B2 | 3/2003 | Siegl et al. | |
| 6,588,739 | B1 * | 7/2003 | Weis | 270/6 |
| 6,601,506 | B2 | 8/2003 | Dauer | |
| 6,647,874 | B1 | 11/2003 | Siegl et al. | |
| 6,779,446 | B2 * | 8/2004 | Hajek et al. | 101/216 |
| 7,143,692 | B2 * | 12/2006 | Schmitt et al. | 101/227 |
| 2001/0018872 | A1 * | 9/2001 | Tokiwa | 101/221 |
| 2002/0029706 | A1 | 3/2002 | Dauer | |
| 2004/0231542 | A1 | 11/2004 | Seyfried | |

FOREIGN PATENT DOCUMENTS

| | | | |
|---|---|---|---|
| DE | 41 28 797 | C2 | 1/1994 |
| DE | 43-40-543 | A1 | 1/1995 |
| DE | 44 30 693 | A1 | 7/1996 |
| DE | 100 38 551 | A1 | 2/2002 |
| DE | 101 35 773 | A1 | 2/2003 |
| DE | 101 63 261 | A1 | 7/2003 |
| EP | 0 882 588 | B1 | 5/1998 |
| JP | 62-130854 | | 6/1987 |

* cited by examiner

Production conditions with five forming devices

| Production conditions Book Structure | Based on standard production conditions Leg guide means (leg path) Sk | Book Structure |
|---|---|---|
| ECADB- | 5 | ECADBF |
| CAEDB- | 8 | CAEDBF |
| -CAFDB | 7 | ECAFDB |
| -CADBF | 5 | ECADBF |
| ECABD- | 1 | ECABDF |
| CAEBD- | 3 | CAEBDF |
| CA-FBD | 4 | CAEFBD |
| -CABDF | 1 | ECABDF |
| CDA-BF | Identical to 18 | CDA-BF |
| EACDB- | 15 | EACDBF |
| -ACDBF | 15 | EACDBF |
| EACBD- | 10 | EACBDF |
| ACEBD- | 12 | ACEBDF |
| -ACFBD | 13 | EACFBD |
| A-CBDF | 11 | AECBDF |
| EA-BCD | Identical to 20 | EA-BCD |

FIG.7

METHOD OF PREADJUSTING A WEB-MACHINING AND/OR WEB-PROCESSING MACHINE, METHOD FOR SELECTING A LEG DIRECTION MEANS AND PREADJUSTMENT SYSTEM

CROSS REFERENCE TO RELATED APPLICATIONS

This application is to the US National Phase, under 35 USC 371, of PCT/EP2004/050117, filed Feb. 11, 2004; published as WO 2004/073986 A1 on Sep. 2, 2004 and claiming priority to DE 103 07 202.0, filed Feb. 20, 2003, the disclosures of which are expressly incorporated herein by reference.

FIELD OF THE INVENTION

The present invention is directed to a method of pre-adjusting a web-processing and/or a web-treatment machine, to a method of selecting a leg direction, and to a pre-adjustment system.

BACKGROUND OF THE INVENTION

DE 25 10 057 A1 discloses a forming device configuration of a web-fed rotary printing press comprising several superposed forming devices. A longitudinal register of longitudinally folded edges can be adjusted by the use of compensator rollers.

DE 41 28 797 C2 discloses a forming device arrangement comprising several forming devices which are mutually superposed, which allow different leg directions and hence also different sequences of the individual books in the product.

EP 0 882 588 B1 discloses a method of controlling a longitudinal register device. As a function of a speed, a preset correction value is fed to the controller of a drive motor for driving the cylinder. The relationship between the correction and the speed can be determined for various types of paper or production conditions by the use of measurement, and can be stored in a database.

DE 44 30 693 A1 discloses printing groups with cylinders that are motor-driven either individually or in groups. Depending on the selected web path, the motor controls are provided with required set-point positions for the cylinders by a computer and a memory unit.

In US 2002/029706 A1, during feeding of a web, the paper path is recorded continuously, from which information the distances between the printing groups and the cut edges on the cutting unit are determined and are used for pre-adjusting the printing group drives with respect to the cut register and/or color register. The determination may also occur with the aid of distances between the printing areas, which are known from the design data.

DE 43 40 543 A1 discloses a web guide system. Upon selection of a certain production condition, leg path information is retrieved from a memory and is transmitted to remote display devices, which are associated with individual rolls which are relevant to the web path.

SUMMARY OF THE INVENTION

The object of the present invention is directed to devising a method of pre-adjusting a web-processing and/or web-treatment machine, to a method of selecting a leg direction, and to a pre-adjustment system.

The object is achieved according to the invention by the provision of a method for pre-adjusting at least one component which influences longitudinal register of a web-processing or web-treating machine. A setting valve or an adjusting valve is derived with the aid of design data and is stored in a machine control unit.

The advantages achievable with the present invention consist in particular that the present invention leads to significant time and cost savings at the production facility, especially during the startup phase. Moreover, the printing operator is provided with options of selecting the ideal or at least the best possible leg guide means, in a reliable fashion, for a given product.

BRIEF DESCRIPTIONS OF THE DRAWINGS

Preferred embodiments of the present invention are illustrated in the drawings and will be described in more detail hereinbelow.

FIG. 7 is a derived specification for book structures.

DESCRIPTION OF THE PREFERRED EMBODIMENTS

Figure 1:
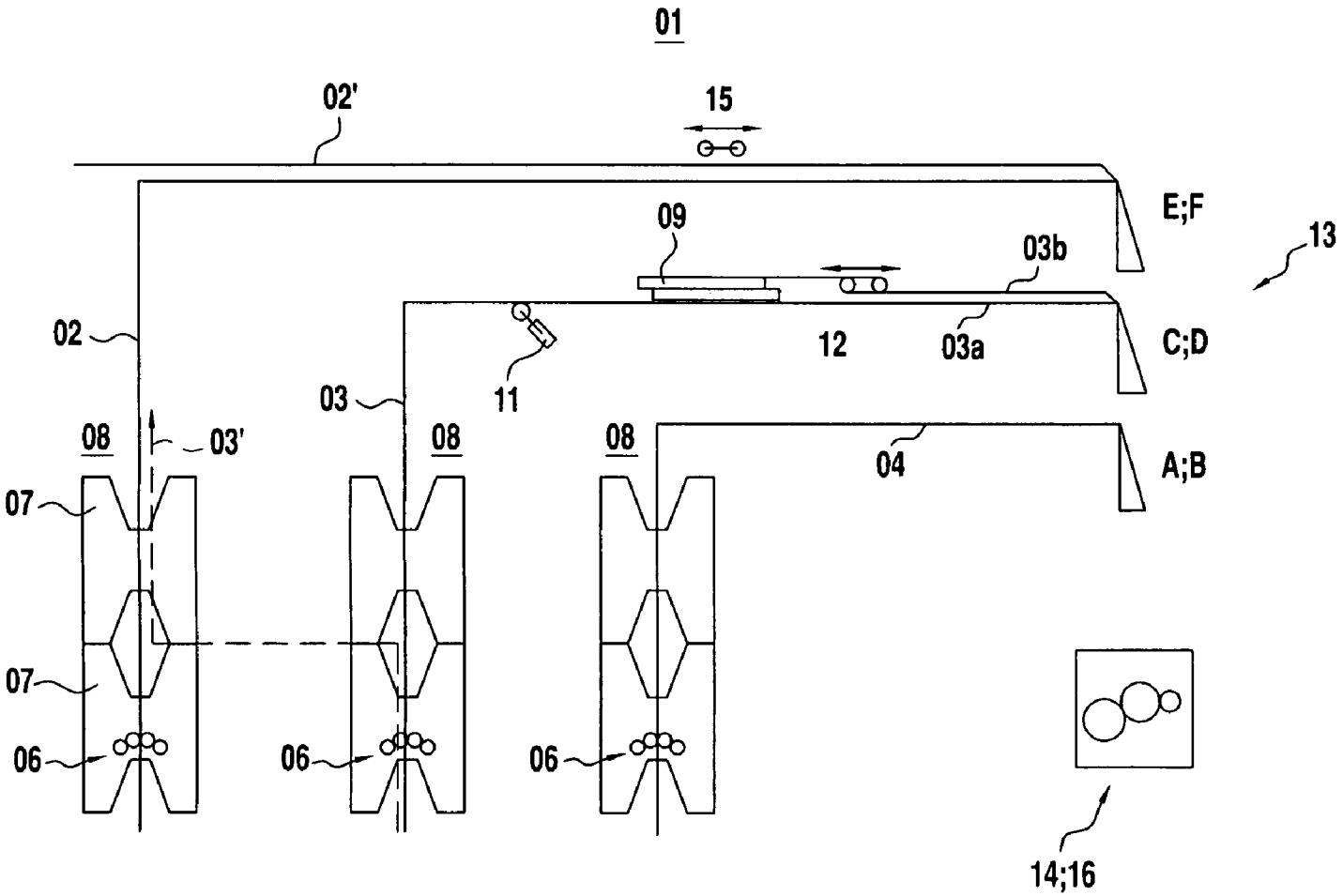
FIG. 1 is a schematic side elevation view of a printing machine.

A web-processing and/or a web-treatment machine 01, such as, for example a printing machine, and particularly a web-fed rotary printing press, comprises for example various possible paths of travel of webs 02, 03, 04 illustrated by way of example in FIG. 1, and with which paths identical or different products can be produced. The printing machine 01 comprises, for example, several printing groups 06, of which printing groups only one is shown for each tower, several printing units 07 and/or several printing towers 08, through which one or more webs runs. For example, during a first production run, these webs are following a first path 03, and during another production run the webs are following another path, illustrated by 03' as a dashed line as an example of a path of a segment of web 03. In the area of a superstructure, which superstructure is itself not shown, the webs are slit longitudinally, such as, for example by a longitudinal slitter 11, and the slit webs may be redirected and aligned using turning or redirecting rods 09. Partial webs 03*a*, 03*b* may be registered longitudinally, in relation to each other, by the use of a registering device 12, such as, for example a secondary registering device 12. One partial web may be guided over the other before the partial webs are fed to a forming device configuration 13 or former and thereafter to a folding apparatus 14, 16.

Figure 2:
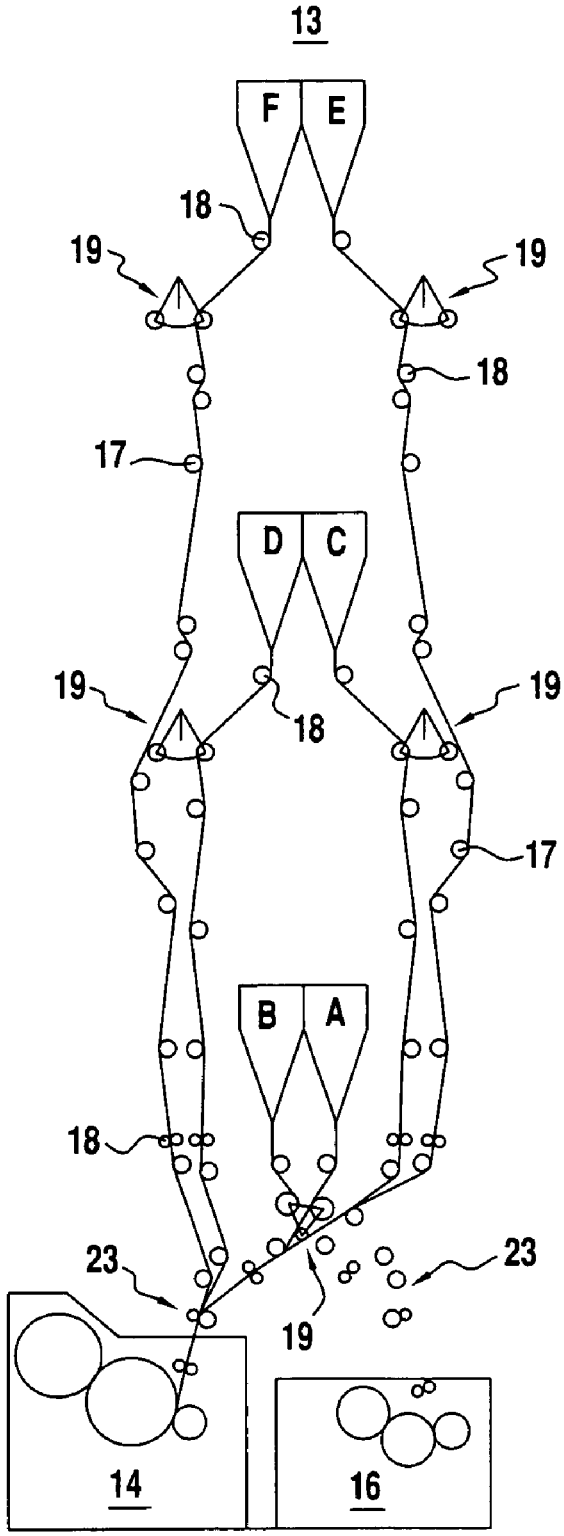
FIG. 2 is a schematic side elevation view of a forming device configuration.

The forming device configuration 13 comprises several forming devices A, B, C, D, E, F, which are disposed in at least two different horizontal planes, as seen in FIG. 2. In the preferred embodiment of the invention, the forming device configuration 13 comprises six forming devices A, B, C, D, E, F, which are arranged in superposed pairs in three planes. Webs running on forming devices A, B, C, D, E, F are folded longitudinally and are then fed as legs or folded webs, having the same reference letters, individually or jointly with other legs A, B, C, D, E, F to one or more folding apparatuses 14, 16. On this course, the legs or folded webs A, B, C, D, E, F are guided over a plurality of rolls 17, 18, such as, for example guide rolls, or deflecting rolls and/or tensioning rolls, such as, for example tensioning roll groups 17, 18. In FIG. 2 only a few of the rolls 17, 18 are illustrated, by way of example. Advantageously, the rolls 17, 18 are driven individually or in groups by respective drive motors which are not shown, and which may be controlled as to their rotational speeds. Depending on the leg guide arrangement , legs A, B, C, D, E, F can interact with other guide- and/or tensioning rolls 17, 18.

Additionally, the forming device configuration or former 13 comprises at least one positioning element 19 for accomplishing the longitudinal register, such as a register device 19, and especially a bundle register device 19. If the forming device configuration 13 comprises n forming devices A, B, C, D, E, F, then advantageously at least n−2 positioning elements 19 are provided. The positioning elements 19 are used to align the legs or folded webs A, B, C, D, E, F in their longitudinal relation to each other in terms of the printed image by changing the path distance.

In the preferred embodiment comprising a total of six forming devices arranged in pairs in three planes, and further comprising the rolls 17, 18, a large number of possible leg guide arrangements or paths can be implemented. With the various leg guide arrangements or paths, different sequences for the legs A, B, C, D, E, F can be configured in the mouth or inlet area of the folding apparatus 14, 16, and hence different book structures can be produced in the resultant folded product. It is also possible, especially when not all of the forming devices A, B, C, D, E, F are required to be used, to achieve the same book structure also through the use of different leg guide arrangements or paths.

For these various leg guide arrangements or paths different leg path lengths exist. Because of these variations in path length, the printed images or the sections of the folding webs, which are received in the folding apparatus are no longer in proper relative adjustment or register longitudinally.

For this reason, typically at least during the start-up phase of the web processing or web-treatment machine 01, a print test must be carried out for all of the planned leg guide arrangements or paths. In this connection, basic settings of the components influencing the longitudinal registers of the webs 02, 03, 04 and/or legs A, B, C, D, E, F, such as, for example the angular positions of the printing groups 06, the position of the secondary register 12, the position of the bundle register device 19, and/or the angular position of the folding apparatus 14, 16, are determined based on the printed images and on the location of the cut to be made. Such basic settings are then stored, for example, for particular web guide paths and/or for leg guide paths. This method is very costly and time-consuming, the more so as the number of forming devices A through F is increased.

Figure 3:
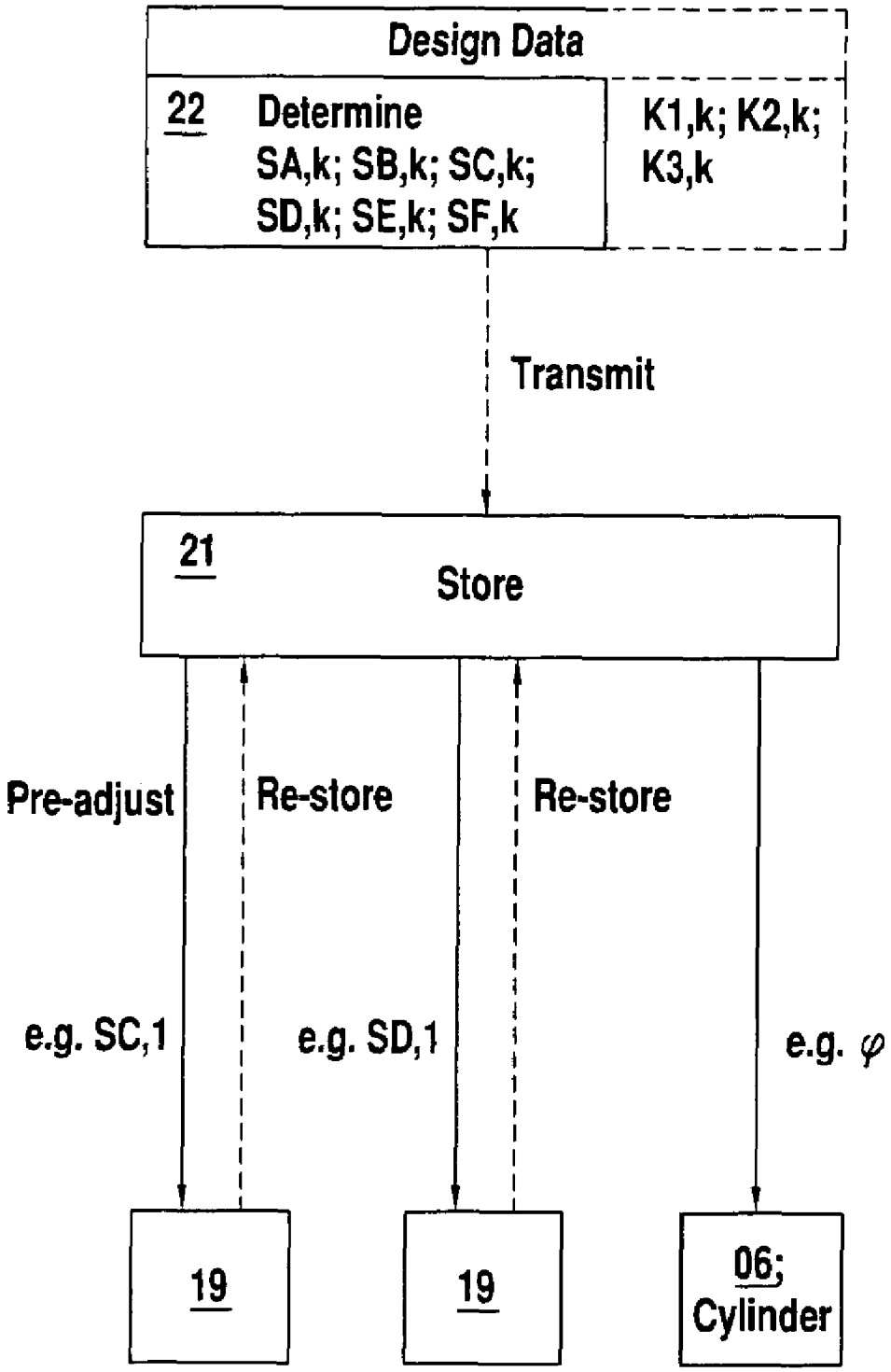
FIG. 3 is a simplified block diagram of the method in accordance with the present invention.
Figure 4:
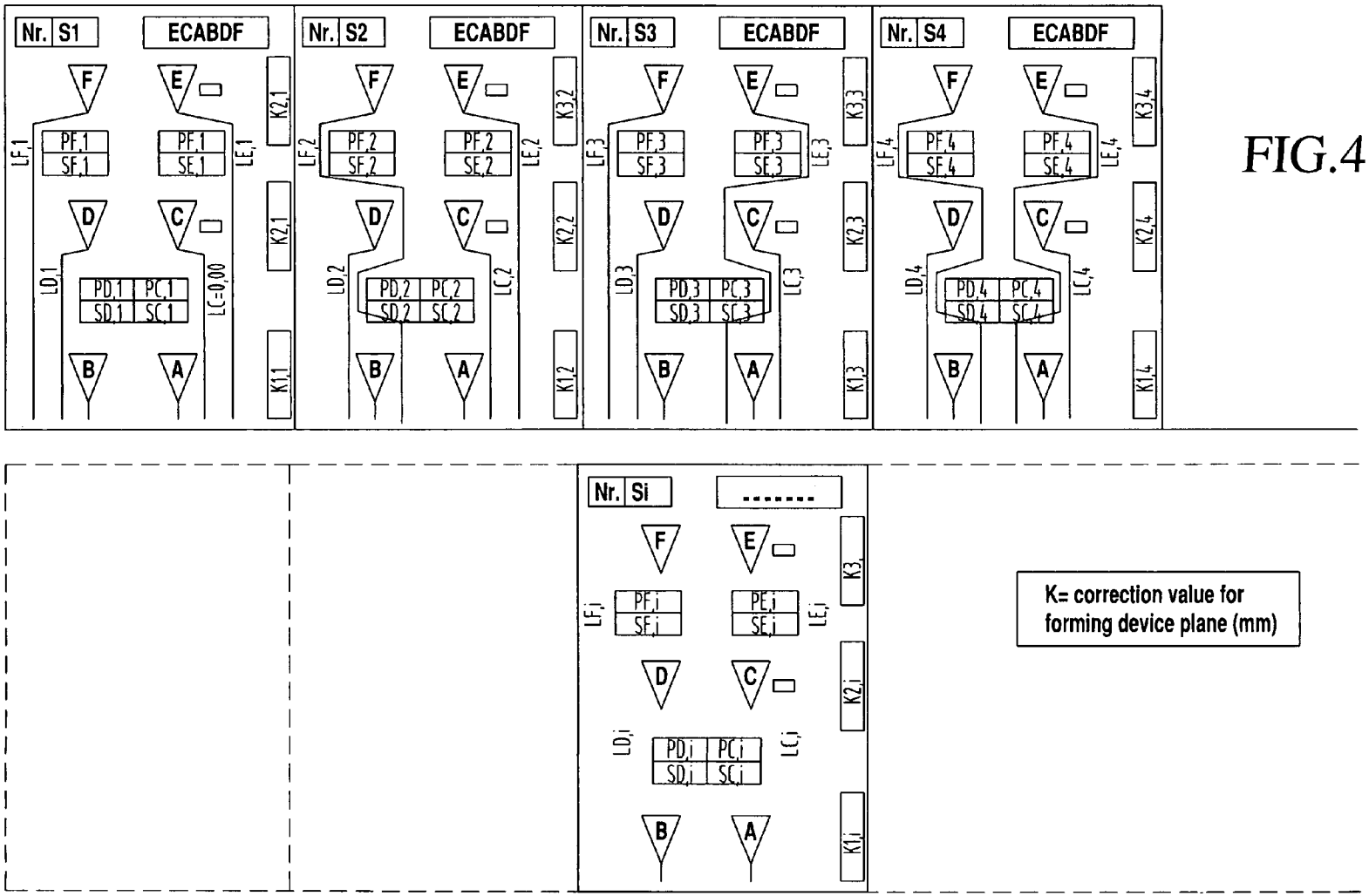
FIG. 4 is a summary of various leg guide arrangements in tabular form.

In the present pre-adjusting method, in accordance with the present invention adjustment values, SA to SF, PA to PF; K1, K2, K3 serving as basic settings for corresponding leg guide paths are derived based on design data, and particularly as data from a CAD program, and are stored in a machine control unit 21 as seen in FIG. 3. FIG. 4 illustrates various leg guide paths Sk, see FIG. 4, where k=1, 2, 3, . . . , in tabular form. This table is by way of example and is not exhaustive. The settings SA to SF; PA to PF; K1, K2, K3 for the various leg guide paths Sk can be assigned absolute positions, or can be assigned physical parameters expressing these. The association of an adjustment value with a certain leg guide path is indicated by the addition of "1", "2" etc. In a variant, the leg guide path can also be defined as a reference guide means for which relative setting values SA to SF; PA to PF; K1, K2, K3 are determined and are stored. For the various register devices, it is also possible to provide mixed forms of the aforementioned methods. For example, the setting values SA to SF may represent adjustment values in mm for elongation of the respective legs A to F which were achieved through by use of the register devices 19 associated with the respective legs A to F. The setting values PA to PF represent, for example, physical parameter values used for this purpose, such as, for example a resistance value on a potentiometer as will be discussed below.

In the preferred embodiment of the method of the present invention and according to FIG. 3, for a given leg guide path Sk, FIG. 4, for k=1, 2, 3, . . . , e.g. for S1, the setting values SA,1 to SF,1 or PA,1 to PF,1 and/or K1,1; K2,1; K3,1 are determined in a data processing unit 22, e.g. by utilization of a program for computer-aided drawing and/or design, on the basis of the design data.

Initially, for this purpose, the longitudinal register for two legs A, B, C, D, E, F of forming devices A, B, C, D, E, F, which are located in pairs side by side in a plane, is used. The rolls 17, 18 located in the region which is below the lowest forming device plane are arranged, in an advantageous arrangement, such that the printed images on the webs exiting from the forming devices A and B are properly positioned in the folding apparatus, according to their longitudinal register. If this is not the case, the legs A and B can be mutually aligned by a common register device 19, which interacts with one or the other of the legs A and B. Alternatively, a separate register device 19 could be provided for each leg A, B.

For the special leg guide path Sk, here S1, the lengths of the two neighboring legs C and D, for example from the exit of the respective forming device to the gripping point 23 where the legs C and D are combined, such as the roll set 23, are determined, and are varied by use of the two associated bundle register devices 19 so that, at the gripping point 23, the printed images become properly positioned and arranged in accordance with the longitudinal register. If the printed images which are arranged next to each other on a cylinder of a printing group, are offset from each other in the circumferential direction, such as, with staggered cylinders, so that the printed images on the two neighboring forming devices C and D are also mutually offset in the longitudinal direction by that same amount, then this offset must additionally be taken into consideration. If the lengths LC and LD, possibly plus the amount of a printed image offset are identical, wherewith the printed images should be exactly superposed at the gripping point 23, then the setting values SC,1, SD,1 and/or PC,1, PD,1 for the bundle register devices 19 are stored for the special leg guide leg paths of legs C and D. The determinations for the two legs E, F are carried out in the same manner. This also applies to the legs A and B, unless the arrangement of the rolls 17, 18 has already ensured the proper settings for the corresponding path segments.

This process can now be performed for all of the leg guide leg paths Sk of interest, such as by way of example S1, S2, S3, S4, as shown in FIG. 4. The adjustment values obtained this way are stored in the data processing unit 22 by, for example, using a file or a database, each in relation to the special leg guide.

The paths of two legs A to F, which are running mutually aligned laterally through the forming devices A to F in a particular forming device plane, are mutually aligned. The mutual alignment of the printed images on the separate webs 02, 03, 04 and/or on the legs, in the various forming device planes, has not yet been taken into consideration. The way in which the printed images from the various forming device planes are mutually disposed at the gripping point 23 and/or in the folding apparatus 14, 16 depends on the respective web guide paths through the printing machine 01 located upstream of the forming device configuration 13 and/or depends on the relative angular positions of the printing groups 06 which print onto the various webs 02, 03, 04. Hereafter this will be referred to as the main register.

The main register of a web 02, 02' can only be changed through the use of register devices 15 which are illustrated only symbolically above the web 02', for example in the superstructure, and/or through a change in the relative rotational angle positions of all of the printing groups 06 which print onto a web 02, 03, 04 relative to those of another web 06. Accordingly, according to a variation of the present invention, the forming device planes may be mutually adjusted through pre-adjustment values K1, K2, K3 of mutual angular positions of the printing groups 06; or, in accordance with to a second variation which is not specifically shown, through pre-adjustment values for corresponding register devices 15 in the longitudinal register. Also, a mixed variation may be provided, in which two sets of pre-adjustment values K1, K2, K3 are employed.

In addition to the pre-adjustment of the previously discussed [leg guide paths Sk in the area of the forming device configuration 13, by the use of the register devices 19, adjustment values K1, K2, K3 for the individual production conditions, for example the web guide web paths through the printing machine 01, are also determined, on the basis of design data. This can be implemented in an embodiment of the present invention wherein, for each web guide path of interest, the respective web path, such as the path between the last print point and the folding apparatus 14, 16 and/or the gripping point 23, is determined by, and is output from the computer-aided drawing and/or from the design program. The paths of two webs running through different forming device planes are compared to each other, and a pre-adjustment value K1, K2, K3 for the angular position and/or a register device 15 is established such that the printed section lengths are properly accurately superposed, according to their longitudinal register, at the gripping point 23. The pre-adjustment value K2, K2, K3 for the respective forming device plane relates to all of the webs, 02, 03, 04 which are guided through this forming device plane, and relates to the printing couples 06 acting on these webs. In the preferred embodiment depicted in FIG. 4, for example, K1 relates to the bottom forming device plane, K2 to the middle forming device plane and, K3 refers to the topmost forming device plane. The further designation, using "1", "2", relates to a coordination with specific leg guide paths. For each leg guide path, however, there may be several production conditions, each with different web guide paths through the printing units 07, so that several sets of pre-adjustment values K1, K2, K3, such as, for example K1,1*a*, K1,2*a*, K1,3*a*; K1,1*b*, K1,2*b*, K1,3*b*; may exist for each leg guide leg path, depending on the web guide.

According to an advantageous embodiment of the present invention, one of the forming device planes, such as, for example the bottom forming device plane, is considered the reference and therefore has the pre-adjustment value K1=0. The setting values K2 and K3 then represent positions relative to that bottom forming device plane. Alternatively, absolute values may be provided; so that, for example a correction value, in millimeters, may be provided for each of the three forming device planes.

The setting values K1,k; K2,k; K3,k are now determined in the data processing unit 22, in conjunction with the particular production conditions, as was described above, for the setting values SA,1 to SF,1 and/or PA,1 to PF,1, that determination being on the basis of the design data. The setting values are then sent to the machine control unit, where they are stored. For a planned production run, these settings are transmitted to the affected positioning elements as the basic settings.

In a variation of the present invention, wherein the pre-adjustment of the "main register" is based entirely on design data, pre-adjustment of the legs A to F in pairs may advantageously be carried out in the aforementioned manner on the basis of design data. For a selected leg guide path Sk, such as a e.g. leg guide path S1, the main register pre-adjustment is determined during the test print operation by use of the off-print. After pre-adjustment of the bundle register devices 19 using the setting values SA,1 to SF,1 and/or PA,1 to PF,1 obtained from the design data, a test print is carried out for one or more of specific web guide paths wherein the angular positions of the printing groups 06 are adjusted, and/or the register devices 15 are adjusted, such that the printed images are mutually aligned in the longitudinal register in the area of the folding apparatus. This production run, together with the leg guide path S1, can, for example, serve as a reference for the setting values K1, K2, K3 for the remaining leg guide paths Sk. The setting values K1, K2, K3 for the remaining leg guide paths Sk are then determined, e.g., solely on the basis of the design documentation, and represent relative values, such as sums or differences, for the reference production run.

A pre-adjustment of the printing groups 06 and possibly of the folding apparatus 14, 16 may also be carried out in relation to a virtual guide axis of the printing machine 01. The adjustment values K1 to K3 will then represent angular positions relative to the guide axis.

Figure 5:
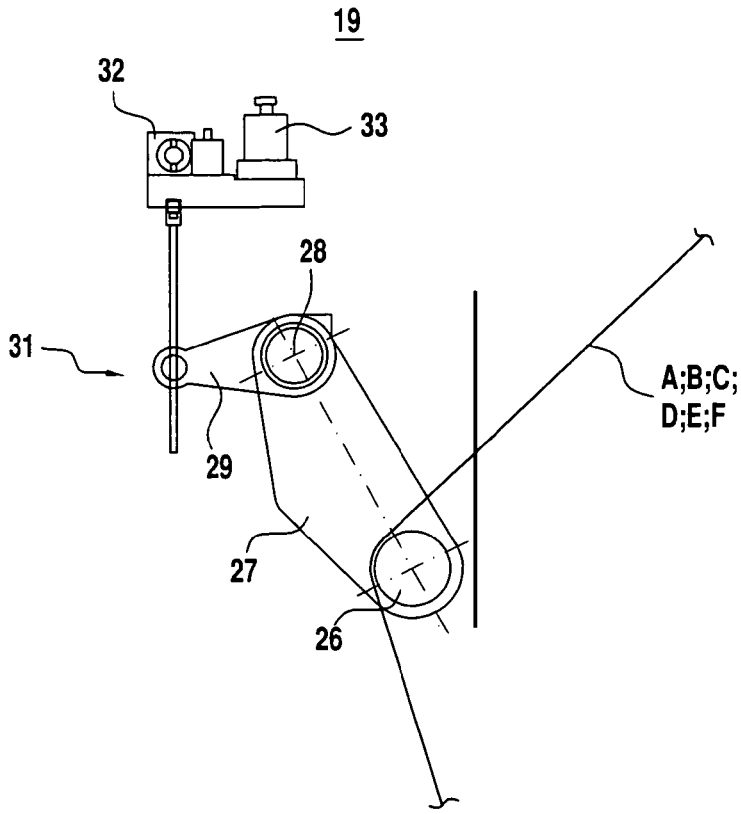
FIG. 5 is an embodiment of a bundle register device.
Figure 6:
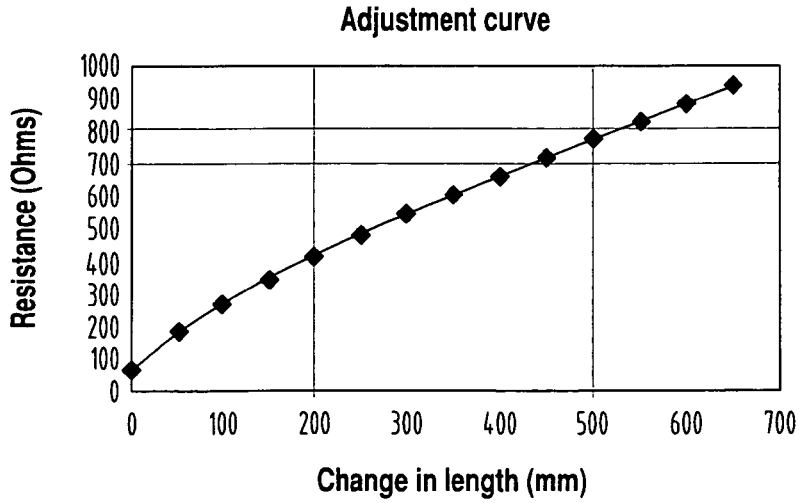
FIG. 6 is an adjustment line of a bundle register device.

The previously discussed register device 19, as depicted in FIG. 5, is advantageously implemented as a roll 26, which is rotatably supported on a lever 27 or on two end-disposed levers. The lever 27 is mounted so as to be swingable about a swing axis which is fixed in relation to the machine frame. For this purpose, the lever 27 is connected, for example in a rotationally fixed manner, to a rotating shaft 28 which, in turn, can be swung by another lever 29. The levers 27, 29 may each also be in the form of a two-armed lever 27, 29, and may be disposed pivotably on a rotationally fixed axis 28. The lever 29 is swung about the swing axis using a drive assembly 31, such as, for example, a threaded pinion drive 31, which pinion drive 31 is driven, in turn, by, an electric motor 32, or the like. A potentiometer 33, which is mechanically coupled to the drive of the threaded pinion 31, is provided, for the purpose of determining the position of the thread on the spindle, and hence for determining the position of the roll 26. With appropriate calibration the resistance value of the potentiometer 33 provides information regarding the elongation and/or the change in length of a leg path, e.g. in mm see FIG. 6.

In addition to the generation of the abovementioned setting values SA to SF; PA to PF; and K1, K2, K3, or independently thereof, the leg guide path Sk may be evaluated and optimized for a desired book structure by use of the design data, in, for example, the data processing unit 22. This is relevant in the event that not all of the available forming devices A to F are required for the product being produced. Several leg guide path Sk may then lead to a given book structure. These do not all tend to be equally suitable, however. An essential criterion for this is the wrap angles of the involved legs A to F around the rolls 14, 16.

In the data processing unit 22, the various wrap angles along the entire leg path are determined for leg guide leg paths Sk meeting the requirements for a given book structure. An advantageous criterion for the selection of the best-suited leg guide path leg path Sk is to select the leg guide so that the smallest maximum wrap angle exists. For this purpose, the maximum wrap angle of the leg guide means Sk is determined for all of the leg guide path Sk in question, and the leg guide paths Sk which has the smallest maximum wrap angle is favored. However, other criteria may also have an influence, which other criteria may also be taken into consideration, with appropriate weightings.

FIG. 7 illustrates, by way of example, a derived specification for book structures, which uses only five of the six forming devices. From all of the possible leg guide paths, a suitable leg guide leg path Sk is assigned to a desired book structure. It is one of the leg guide leg paths Sk which resulted from the use of all of six forming devices, A to F. The possible leg guide path Sk, with consideration of all of the existing forming devices A to F, hence represent standard production conditions, on which the selected leg guide means Sk are based. The minus sign "–" in column 1 symbolizes the leg A to F which is inoperative compared to the standard production run using all of the legs A to F. In other words, the corresponding forming device A to F is not being used. The circumstance mentioned for five forming devices may be applied similarly for book structures with only three or only four books.

A criterion for selecting the best-suited leg guide path Sk, which criterion is different from the above criterion and which may be used in addition to it or as an alternative, especially when changing from a recently produced product to a different one, is a parameter of the required changes in relation to the web path that was just specified. It may be better, for example, to run the webs and/or the folded web legs in the forming device configuration 13 with perhaps less favorable wraps, as set for in the above criterion, and thus to be able to leave the majority of the webs on their paths all the way to the intake of the forming device, than to achieve optimal leg paths in the forming device configuration 13 while, at the same time, having to re-feed all of the webs again from the start.

The criteria may also be incorporated in a mixed decision matrix, an algorithm of a program or a fuzzy logic process.

While a preferred method for pre-adjusting a web-machine and/or web-processing machine, a method for selecting a leg direction and a pre-adjustment system, all in accordance with the present invention have been set forth fully and completely hereinabove, it will be apparent to one of skill in the art that various changes in, for example the specific structure of the printing groups and of the formers and folders, and the like could be made without departing from the true spirit and scope of the present invention which is accordingly to be limited by the appended claims.

What is claimed is:

1. A method of pre-adjusting a leg guide path in a forming device configuration of a web-processing machine including:

providing a plurality of longitudinal fold forming devices in said forming device configuration;

using said plurality of longitudinal fold forming devices for each forming a folded web strand printed by said web-processing machine;

arranging first and second ones of said plurality of longitudinal fold forming devices on a first horizontal plane;

arranging third and fourth ones of said plurality of longitudinal forming devices on a second horizontal plane different from said first horizontal plane;

providing a folding apparatus after, in a direction of web travel, a last one of said plurality of longitudinal fold forming devices;

providing a separate leg guide path of travel from each said longitudinal fold forming device to said folding apparatus;

providing at least one positioning element in said forming device configuration in at least one of said separate leg guide paths of travel of at least one of said folded web strands intermediate at least one of said plurality of longitudinal forming devices and said folding apparatus;

using said at least one positioning element for varying a longitudinal length of said at least one of said separate leg guide paths of travel of said at least one folded web strand;

providing a setting value for said at least one positioning element for any given one of said separate leg guide paths of travel of one of said a folded web strands;

obtaining said setting value for said at least one positioning element using design data obtained from a computer-aided design program;

storing said setting value in a machine control unit;

using said machine control unit containing said setting value for positioning said at least one positioning element for any given path of travel of one of said separate folded web strands in a production condition of said web-processing machine;

determining a subsequent correction of said at least one positioning element during production of said web-processing machine; and using said subsequent correction in said control unit as a new setting value for said at least one positioning element for said at least one of said separate folded web strands.

2. The method of claim 1 further including providing a second setting value for a second production condition and deriving said second setting value as a relative value of said setting value of said first production condition.

3. The method of claim 1 further including delivering said setting value as an absolute value of a variable describing a length and elongation of said web.

4. The method of claim 1 further including using geometric features for deriving said setting value.

5. A system for pre-adjusting a plurality of web guide paths for different production conditions in a forming device configuration of a web-processing machine including:

providing a plurality of longitudinal fold forming devices in said forming device configuration;

using said plurality of longitudinal fold forming devices for each forming a folded web strand provided by said web-processing machine;

arranging first and second ones of said plurality of longitudinal fold forming devices on a first horizontal plane;

arranging third and fourth ones of said plurality of longitudinal fold forming devices on a second horizontal plane different from said first horizontal plane;

providing a folding apparatus after, in a direction of travel of said folded web strands, a last one of said plurality of longitudinal fold forming devices;

providing a separate one of said plurality of web guide paths from each said longitudinal fold forming device to said folding apparatus;

providing at least one positioning element disposed in one of said web guide paths of at least one folded web in said forming device configuration intermediate at least one of said plurality of longitudinal fold forming devices and said fold apparatus;

providing a means for providing a computer-aided design of said web-processing machine;

providing a storage medium associated with said web-processing machine;

using said means for providing said computer-aided design of said web-processing machine for determining a first path length of a first one of said plurality of web guide paths inside said forming device configuration relative to a second path length of a second one of said plurality of web guide paths inside said forming device configuration;

generating a setting value for said at least one positioning element using said determined first path length;

storing said setting value in said storage medium; and inputting said setting value into said at least one positioning element for positioning said at least one positioning element in accordance with said determined first path length of said first one of said web guide paths inside said forming device configuration.

* * * * *